US007758443B1

(12) United States Patent
Ford

(10) Patent No.: US 7,758,443 B1
(45) Date of Patent: Jul. 20, 2010

(54) GOLF WORK STATION

(76) Inventor: David D. Ford, 515 Center St., Hanover, MA (US) 02339

( * ) Notice: Subject to any disclaimer, the term of this patent is extended or adjusted under 35 U.S.C. 154(b) by 0 days.

(21) Appl. No.: 12/321,206

(22) Filed: Jan. 16, 2009

Related U.S. Application Data

(60) Provisional application No. 61/011,250, filed on Jan. 16, 2008.

(51) Int. Cl.
*A63B 69/36* (2006.01)

(52) U.S. Cl. ..... 473/266; 473/270; 473/272; 473/273

(58) Field of Classification Search ..... 473/207, 473/218, 219, 227, 257, 258, 261, 266, 268, 473/270, 271–273, 277
See application file for complete search history.

(56) References Cited

U.S. PATENT DOCUMENTS

| | | | | |
|---|---|---|---|---|
| 3,623,733 | A | 11/1971 | Cavanaugh | |
| 4,659,084 | A | 4/1987 | Vuick | |
| 4,758,001 | A | 7/1988 | Otting et al. | |
| 4,993,716 | A | 2/1991 | Waller | |
| 5,255,921 | A | 10/1993 | Spence | |
| 5,456,470 | A | 10/1995 | Scheurer | |
| 5,591,090 | A | 1/1997 | Kauffman, Jr. | |
| 5,616,085 | A * | 4/1997 | LaCoste et al. | 473/267 |
| 5,707,300 | A | 1/1998 | May et al. | |
| 5,762,565 | A | 6/1998 | Milam et al. | |
| 5,769,732 | A | 6/1998 | O'Neal | |
| 5,830,079 | A | 11/1998 | Hudson | |
| 6,024,656 | A | 2/2000 | Lane | |
| 6,174,270 | B1 | 1/2001 | Dagenais | |
| 6,497,627 | B2 | 12/2002 | Collins | |
| 6,551,196 | B1 | 4/2003 | Kossnar et al. | |
| 6,575,844 | B1 | 6/2003 | Gray | |
| 6,843,730 | B1 | 1/2005 | Bellagamba | |
| 6,988,957 | B2 | 1/2006 | Bender | |
| 7,066,828 | B2 | 6/2006 | Lee et al. | |
| D574,916 | S * | 8/2008 | Ford | D21/791 |
| 2006/0121999 | A1 | 6/2006 | Bender | |
| 2007/0015598 | A1 | 1/2007 | Lloyd | |

* cited by examiner

*Primary Examiner*—Nini Legesse
(74) *Attorney, Agent, or Firm*—John P. McGonagle

(57) ABSTRACT

A golf work station having a base module with telescoping knee guides and adjustable target knee posts. A rear attachment module having a posture post is removably attached to the base module rear, said posture post being longitudinally extensible and angularly adjustable. A front attachment module having two adjustable swing plane tubes is removably attached to the base module front, said swing plane tubes being vertically and angularly adjustable. A putting module having an adjustable putter shaft slide is removably attached to the base module front, said putter shaft slide being vertically and horizontally adjustable.

10 Claims, 17 Drawing Sheets

REAR ATTACHMENT

GOLF WORK STATION

CROSS-REFERENCE TO RELATED APPLICATIONS

Applicant claims the priority benefits of U.S. Provisional Patent Application No. 61/011,250, filed Jan. 16, 2008.

BACKGROUND OF THE INVENTION

This invention relates to a golf training apparatus, and in particular, to an apparatus for aligning a golfer's body for all aspects of a swing a golf club, including drivers, fairway woods, utility clubs, irons and putters.

Golf is an addictive sport and can be very frustrating. It is a sport which relies primarily on technique for effective play. Techniques required for all of the shots required in golf, i.e., driving a ball, fairway wood shots, iron play and putting, have many common elements but also some different elements. For example, the position of the golfer's body with respect to the golf ball, the position of the golfer's body itself, i.e., stance, the take away of the golf club and follow through when striking the golf ball, all have similarities and variables for each shot. Although the various techniques may be learned, muscle and mind memory for the various techniques will vary depending upon a golfer's condition, lapsed time, or many of life's living challenges faced by all golfers.

The prior art is full of a wide variety of training devices for golfers. Each of the devices focuses on one or a few of the technique aspects required for a golf swing. Most of the devices focus on teaching new techniques. Few, if any, focus on refreshing memory of a previously learned technique. For most golfers, access to a wide variety of training devices is just impractical.

Golf professionals may have a few training devices to help instruction. However, there is an expense involved, both for the devices themselves but also in time lost setting up each training device for instruction.

What is required is a global training apparatus which provides means for teaching and reviewing all of the techniques used in playing golf, including driving a ball, fairway wood shots, iron play and putting.

SUMMARY OF THE INVENTION

The present invention addresses the above problems by providing a golf work station which provides comprehensive teaching and review of the techniques required for making golf shots. The workstation teaches lower body stability encouraging proper balance, level hip rotation and delivering the golf club with effortless power. The workstation helps identify improper golfing movements such as sway, lunge, stand up, "come out of the shot", loss of balance, the "over the top", "the slide" and "duck under" moves. The present invention establishes correct pattern movement which helps groove a golf swing. The present invention helps improve a golfer's swing plane by teaching turns in balance, maintaining posture, rotation of shoulders and arms with connection and extension. The workstation assists in teaching proper footwork and clearing of the hip move. The work station putting module gives a golfer the ability to choose the lie angle and the degree of arc to roll his best putt. The present invention provides the means to teach new techniques and review old techniques.

The present invention accomplishes the above objects by providing a golf work station having a base module with telescoping knee guides and adjustable target knee posts. A rear attachment module having a posture post is removably attached to the base module rear, said posture post being longitudinally extensible and angularly adjustable. A front attachment module is having two adjustable swing plane tubes is removably attached to the base module front, said swing plane tubes being vertically and angularly adjustable. A putting module having an adjustable putter shaft slide removably attached to the base module front, said putter shaft slide being vertically and horizontally adjustable.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
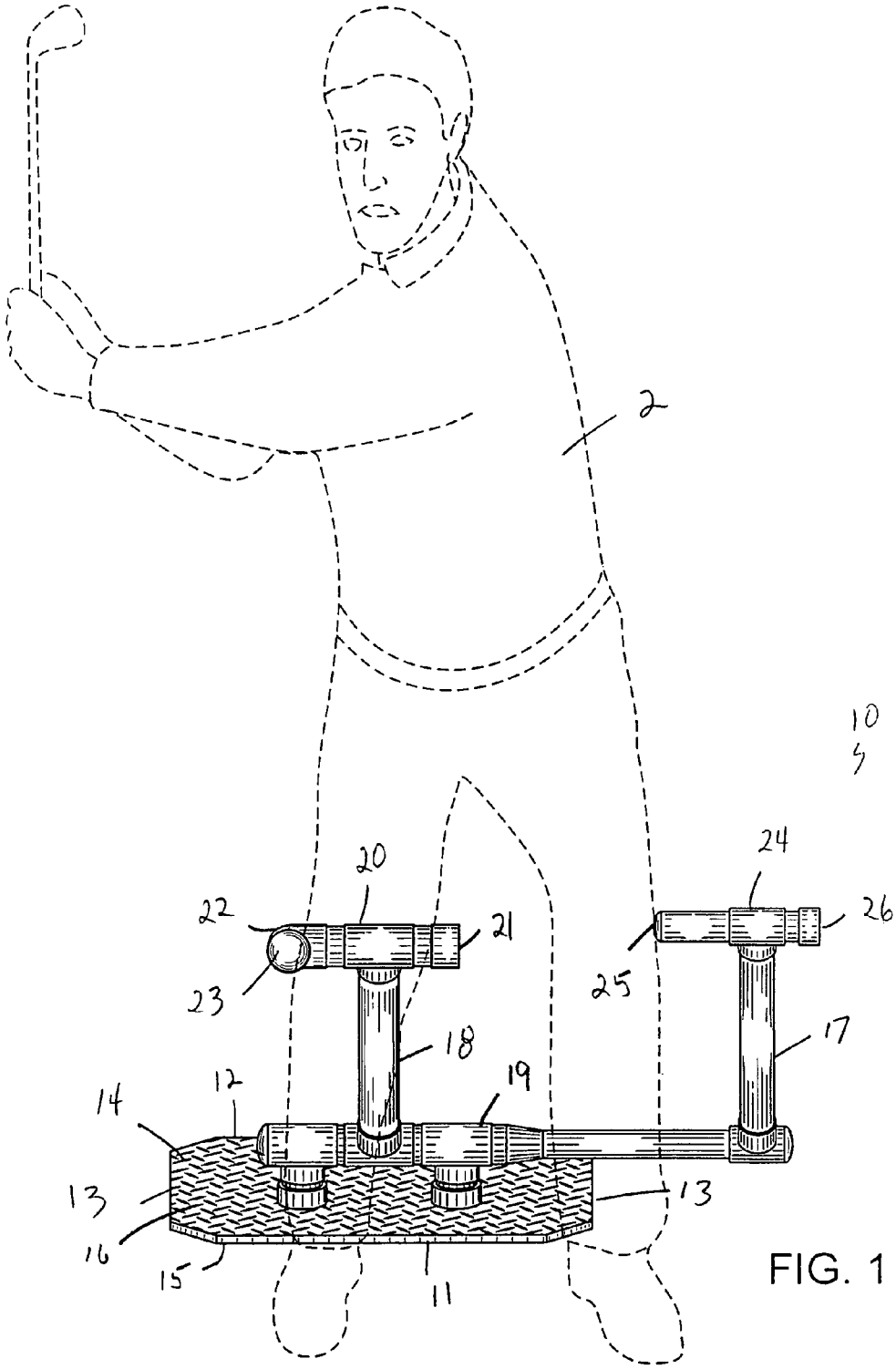
FIG. 1 is a front perspective view of the base module.

Referring to the drawings in detail wherein like elements are indicated by like numerals, there is shown a golf work station 1 comprised of a base module 10, a rear attachment module 30 attached to the base module, a front attachment module 40 attached to the base module, and a putting module 50 removably attached to the base module.

The base module 10 has a front 11, rear 12, and two opposite sides 13, said base module front and rear defining a work station central axis, said base module opposite sides defining a base module transverse axis. The base module 10 is comprised of a base plate 14 having a bottom surface 15 and a top surface 16. The base plate 14 has a generally rectangular shape and may be made from a marine grade PVC. The base plate bottom surface 15 is adapted to rest on an indoor floor or outdoor surface such as a mat or ground. The base plate bottom surface 15 may have means to prevent slippage. The base module 10 is further comprised of two telescoping knee guides, a left knee guide 17 and a right knee guide 18, pivotally extending from a base bar 19 fixedly attached centrally to the base plate top surface 16, said base bar having a longitudinal axis parallel to the base module transverse axis. The base plate 14 has several storage/transport holders 27 fixedly attached to the base plate top surface 16 between the base bar 19 and a rear base plate edge 28.

The right knee guide 18 terminates in an elongated pivot element 20, said pivot element having a longitudinal axis parallel to the base module transverse axis. The pivot element 20 has an inside end 21 and an outside end 22, said outside end terminating in a forwarding extending protrusion 23. The left knee guide 17 terminates in an adjustable target knee rod 24 with an inside end 25 and an outside end 26, said inside and outside ends defining a target knee rod longitudinal axis, said target knee rod longitudinal axis being parallel to the base module transverse axis.

Figure 2:
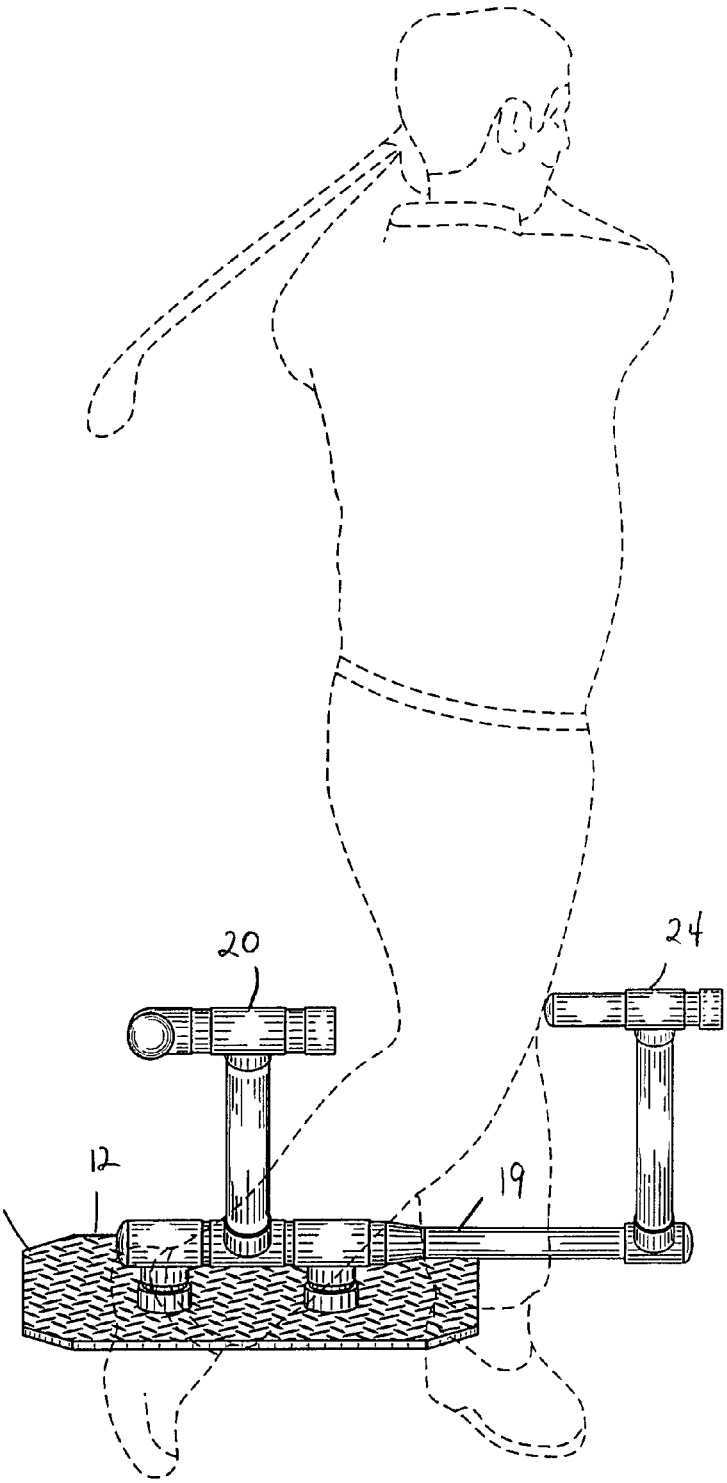
FIG. 2 is another front perspective view of the base module.
Figure 3:
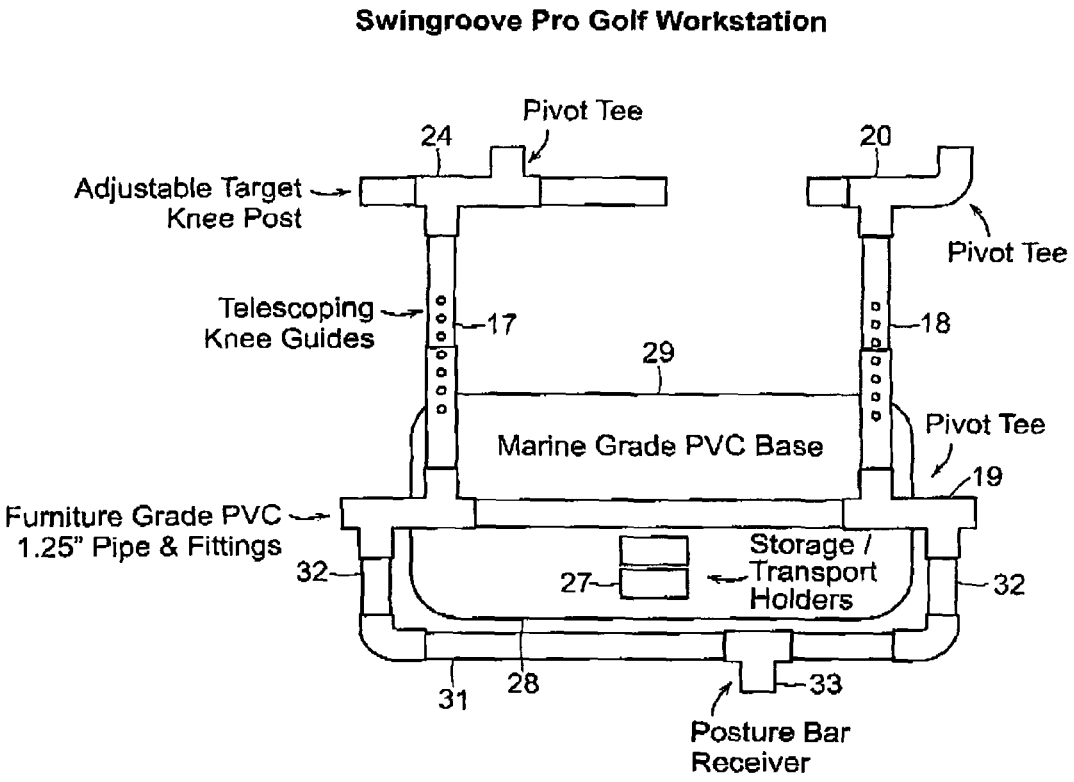
FIG. 3 is a rear perspective view of the base module with rear attachment module.
Figure 4:
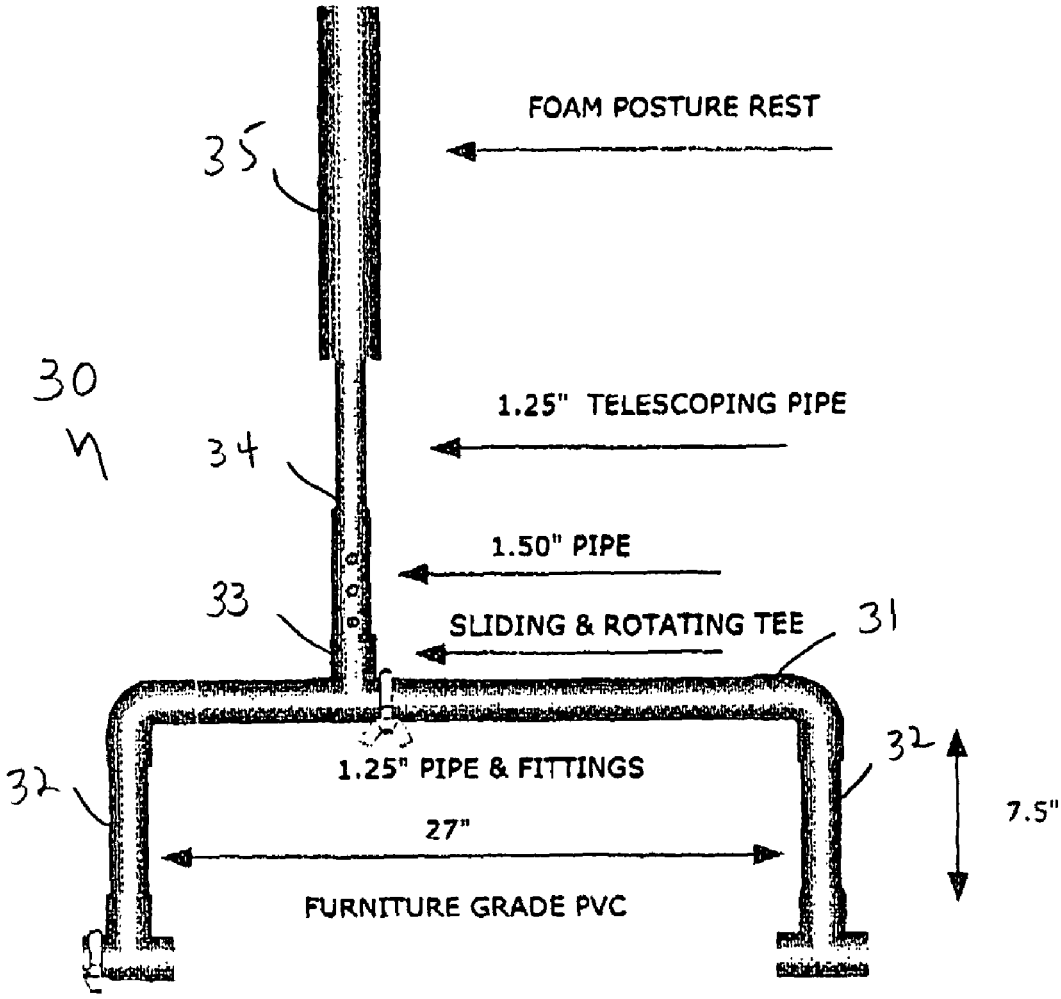
FIG. 4 is a front view of the rear attachment module.
Figure 5:
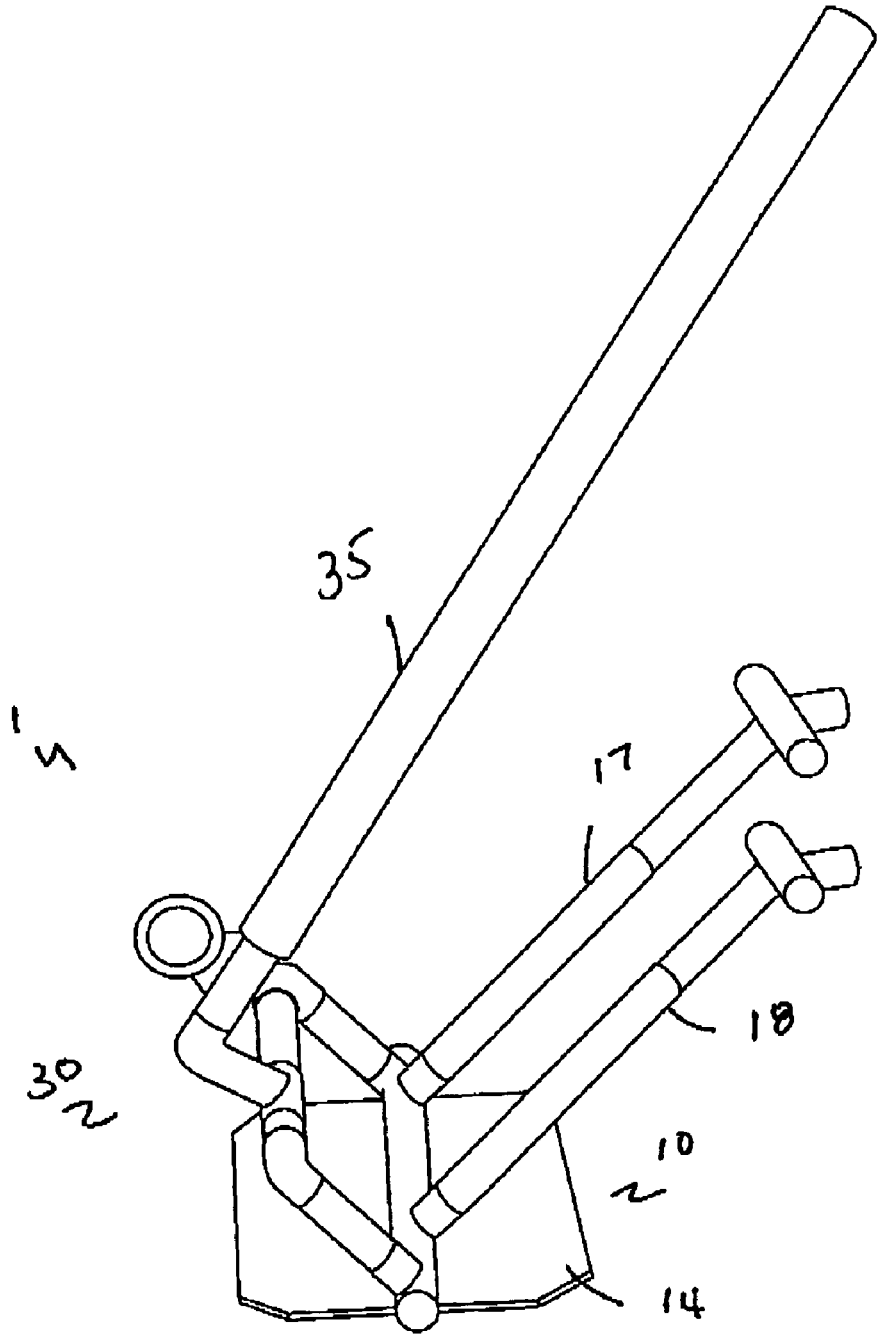
FIG. 5 is a side perspective view of the rear attachment module.
Figure 6:
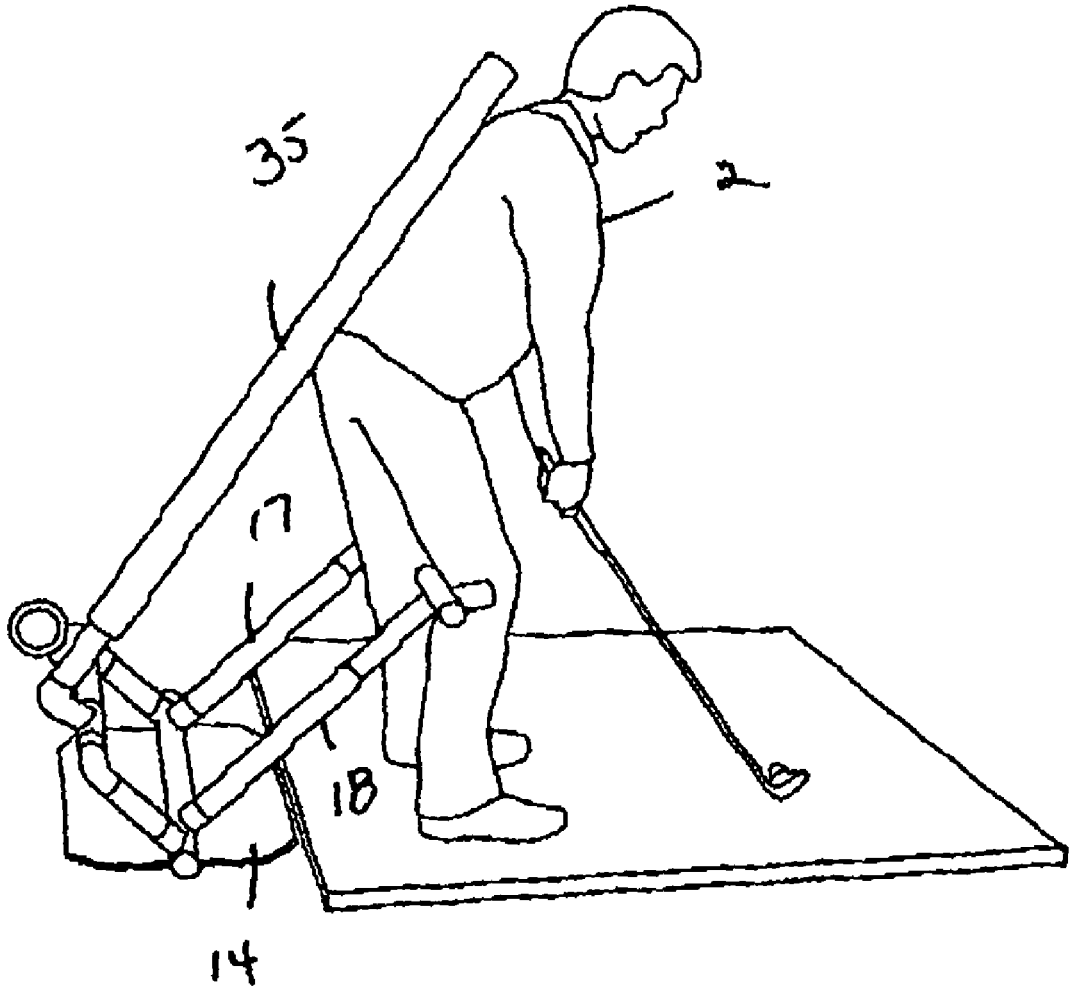
FIG. 6 is a view as shown in FIG. 5 with a golfer.
Figure 7:
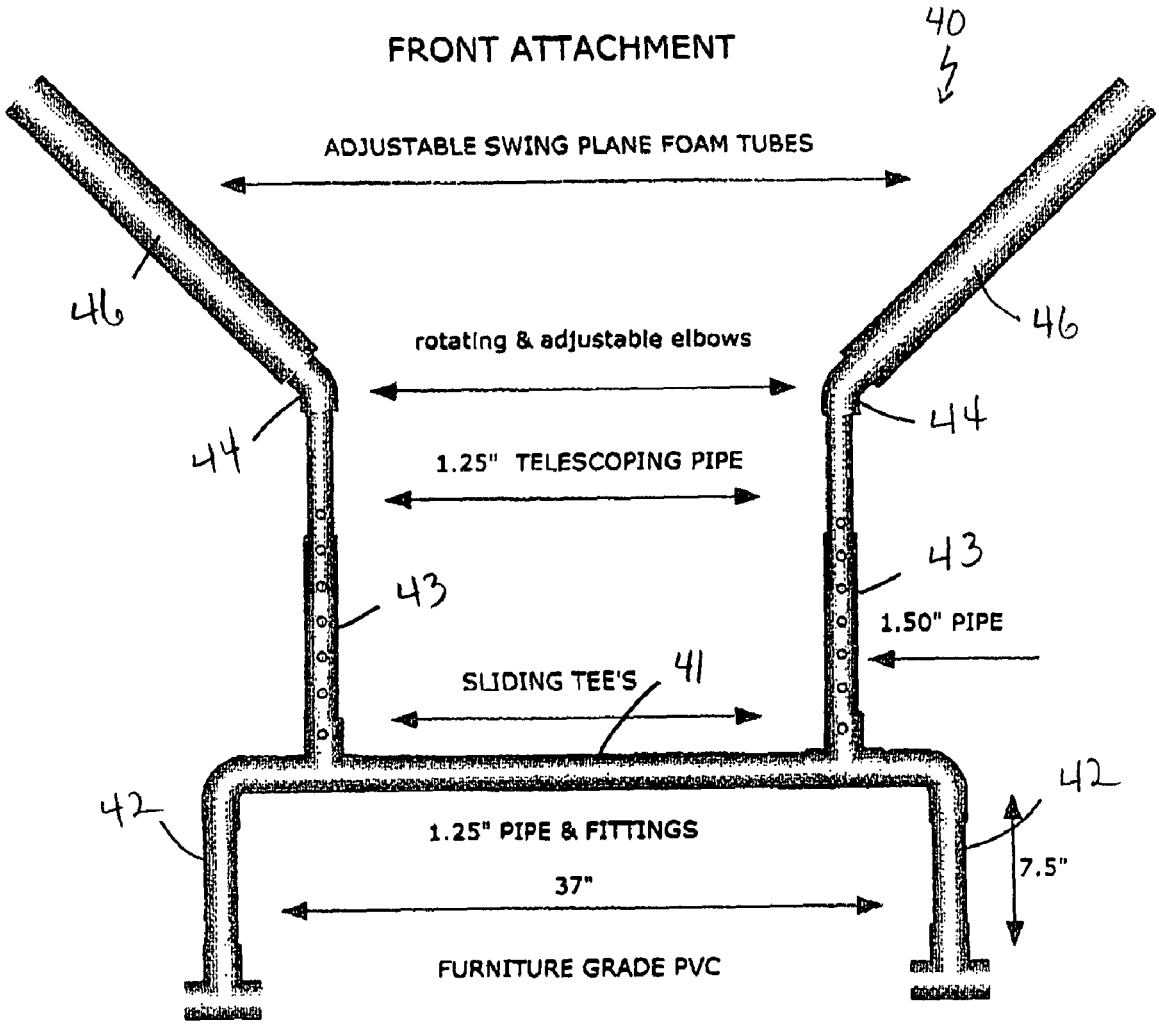
FIG. 7 is a top rear perspective view of the front attachment module.
Figure 8:
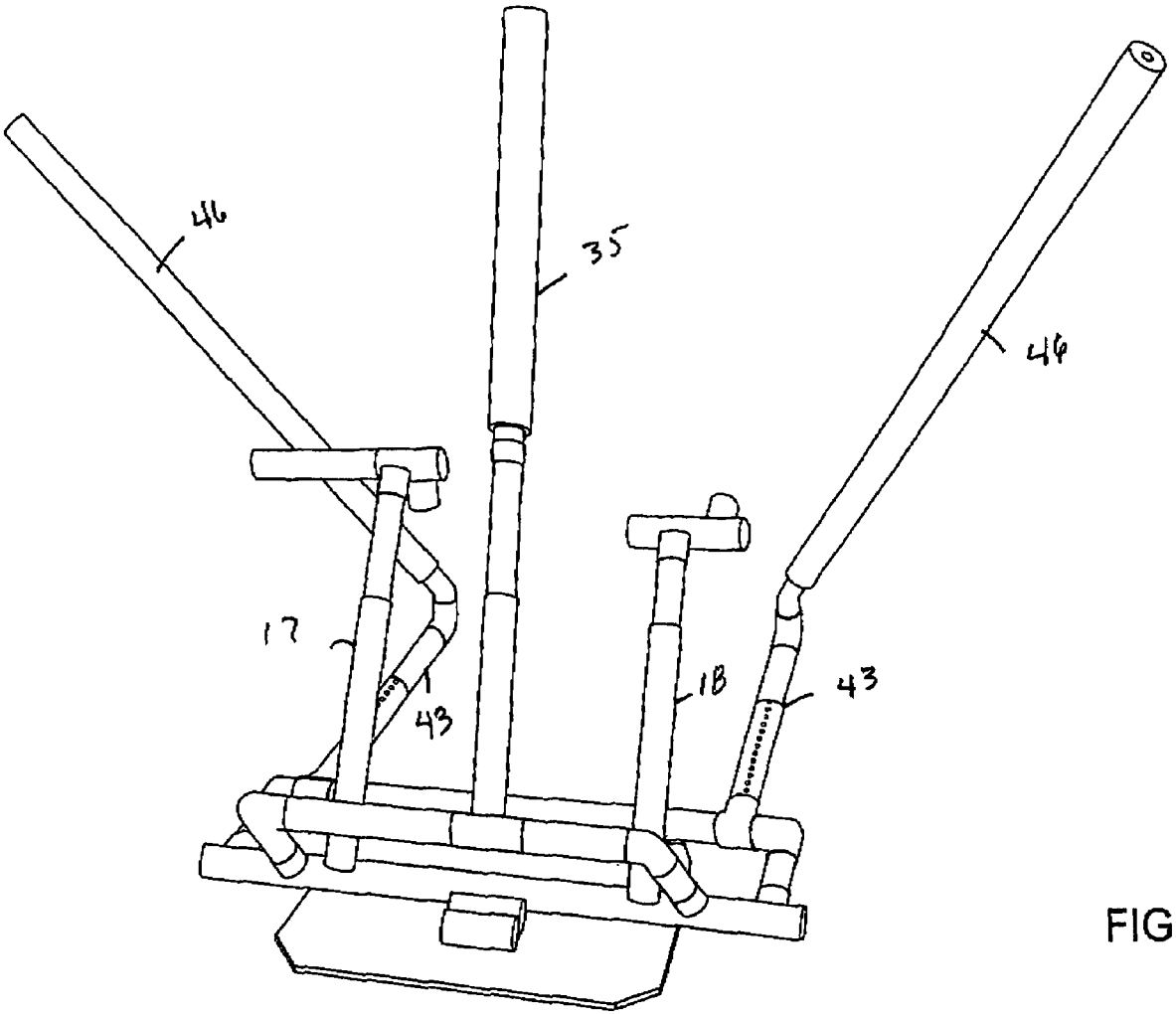
FIG. 8 is a rear perspective view of the front attachment module.
Figure 9:
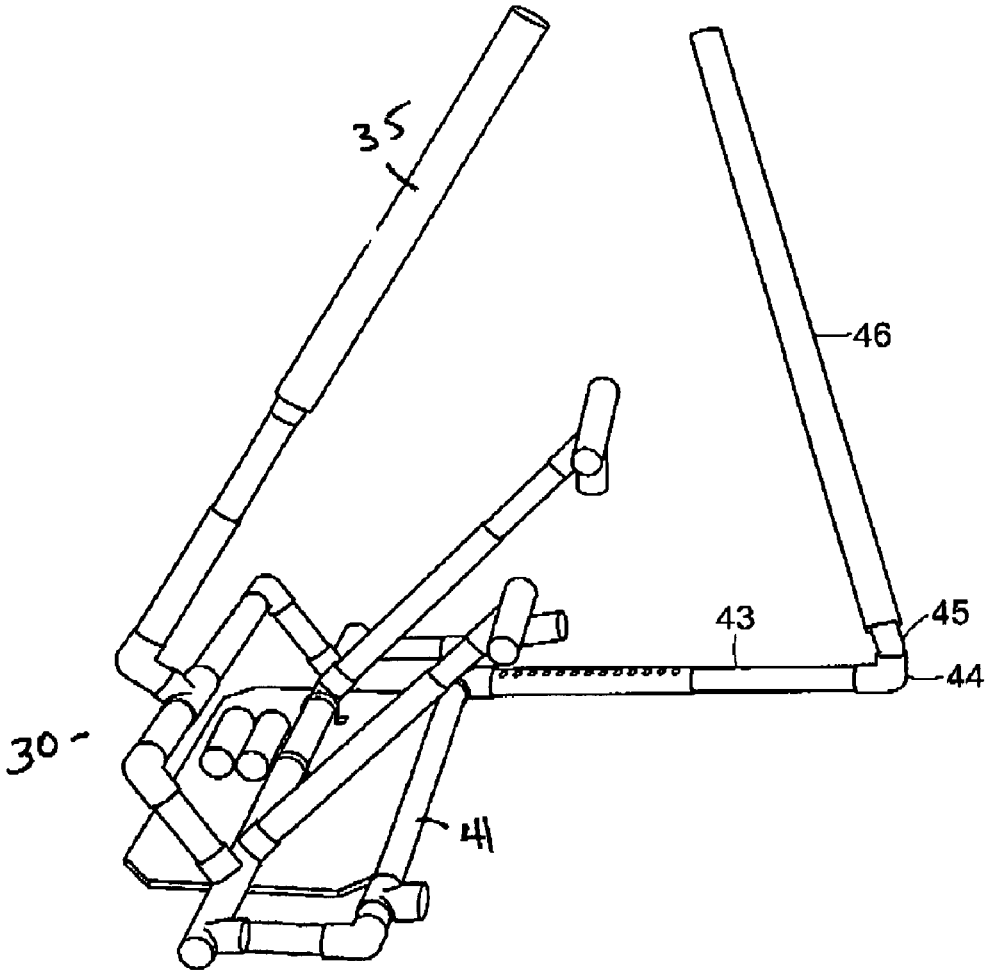
FIG. 9 is a side perspective view of the front attachment module with the right guide omitted.
Figure 10:
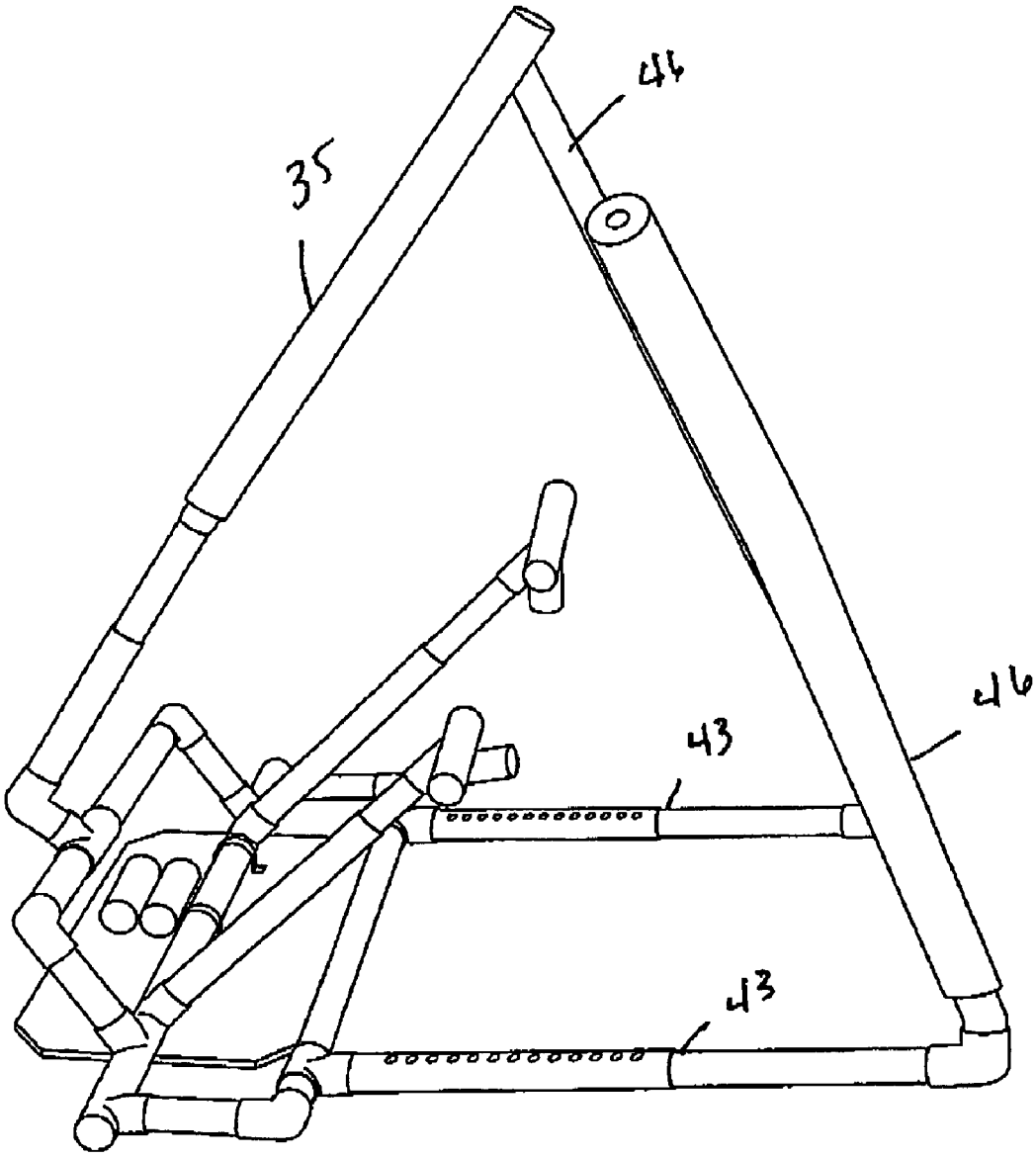
FIG. 10 is a side perspective view of the front attachment module.
Figure 11:
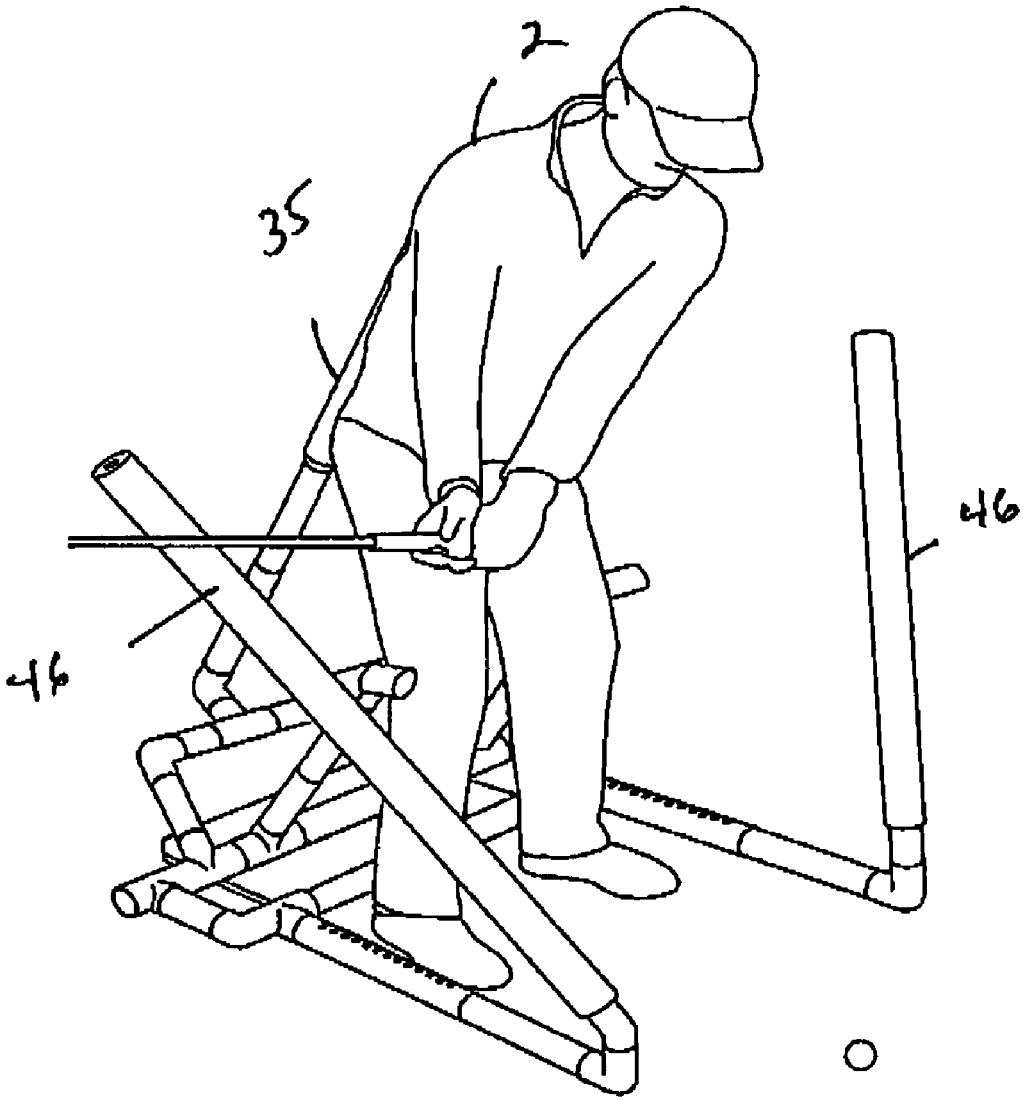
FIG. 11 is a front side perspective view of the front attachment module with a golfer.
Figure 12:
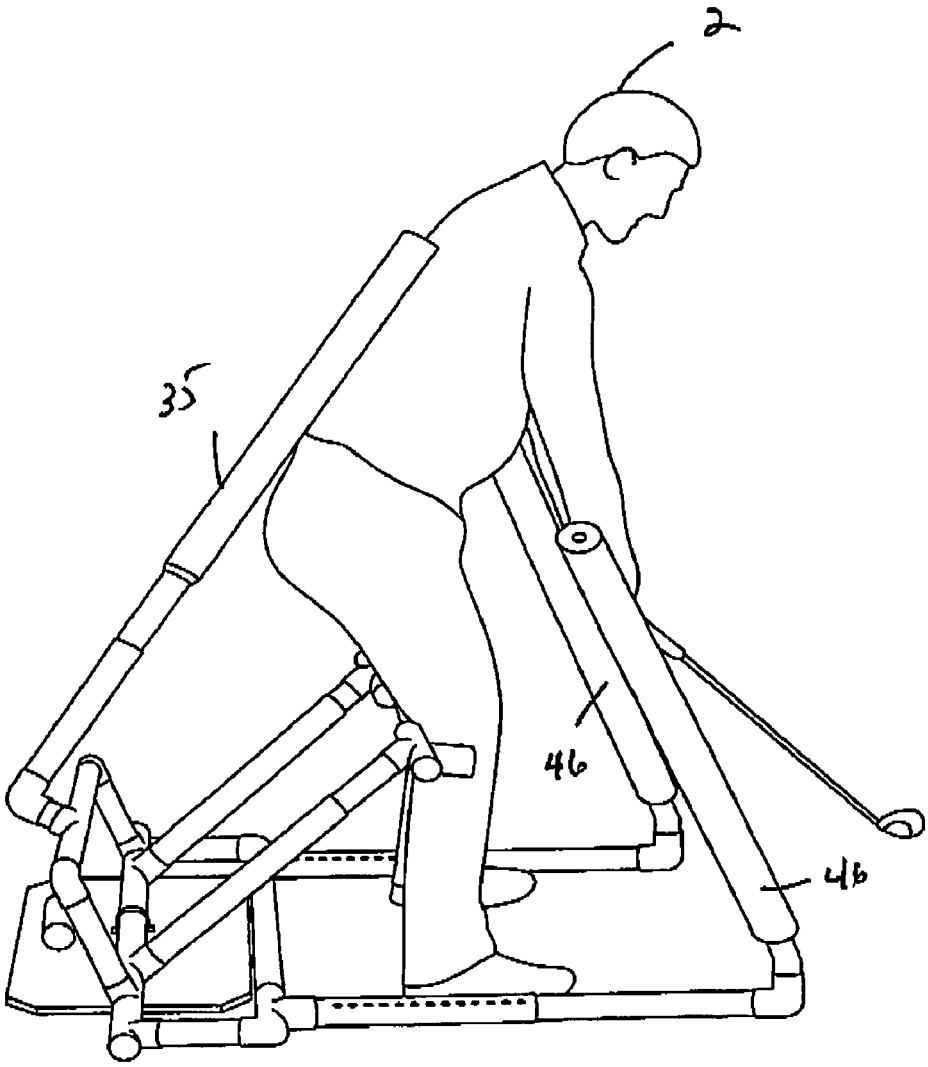
FIG. 12 is a side perspective view of the front attachment module with a golfer.
Figure 13:
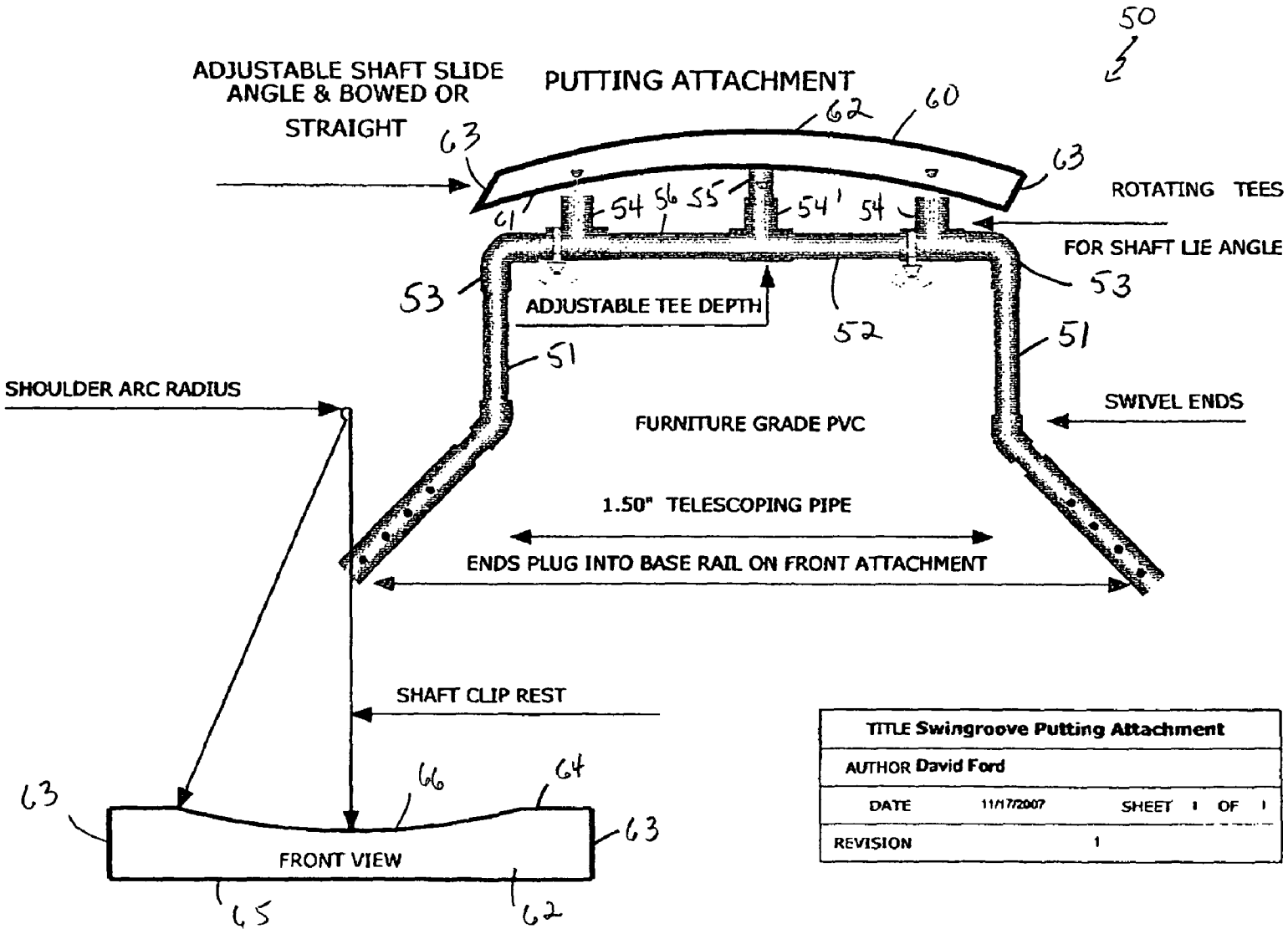
FIG. 13 is a rear perspective view of the putting module.
Figure 14:
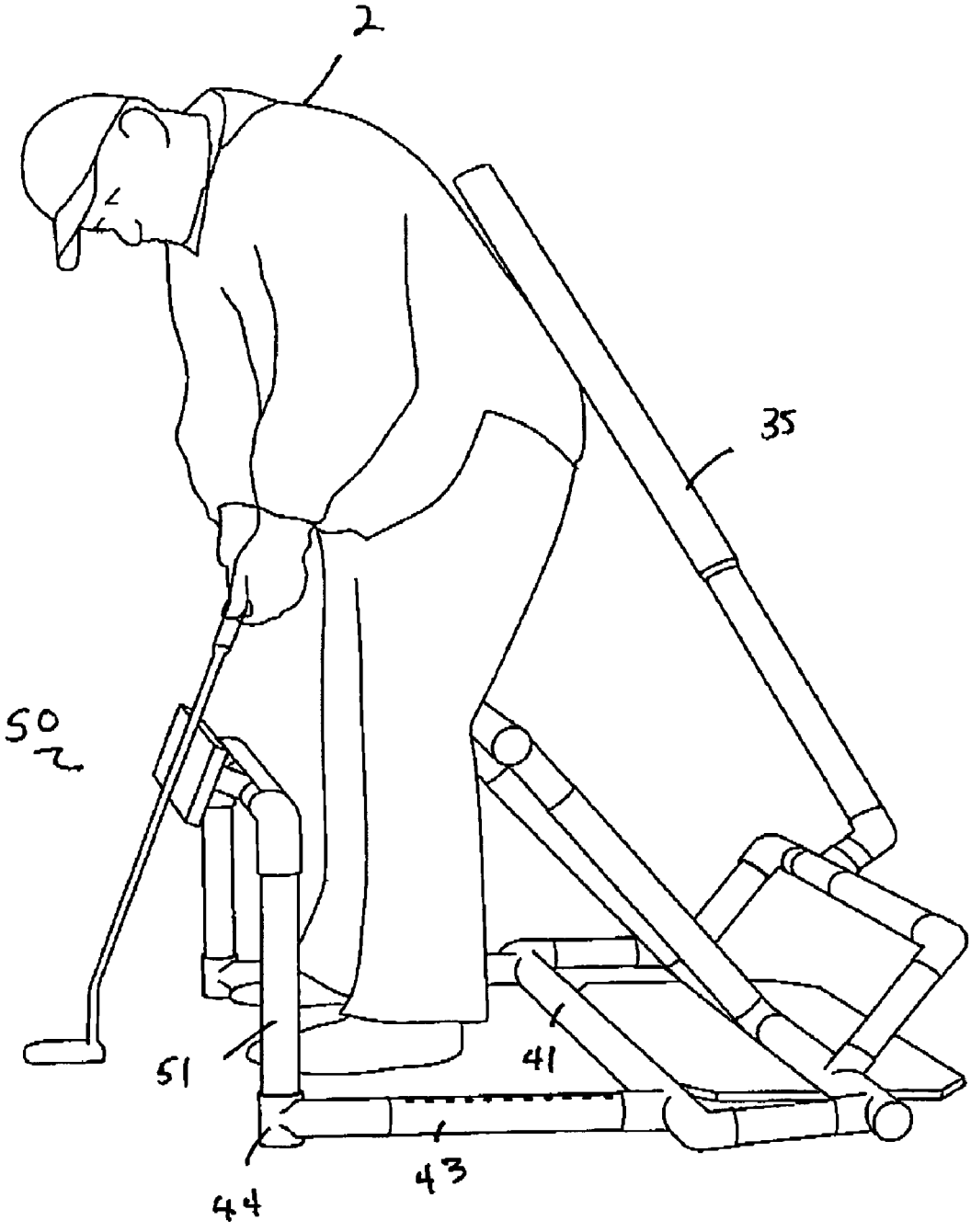
FIG. 14 is a side perspective view of the putting module attached to the base module with a golfer.
Figure 15:
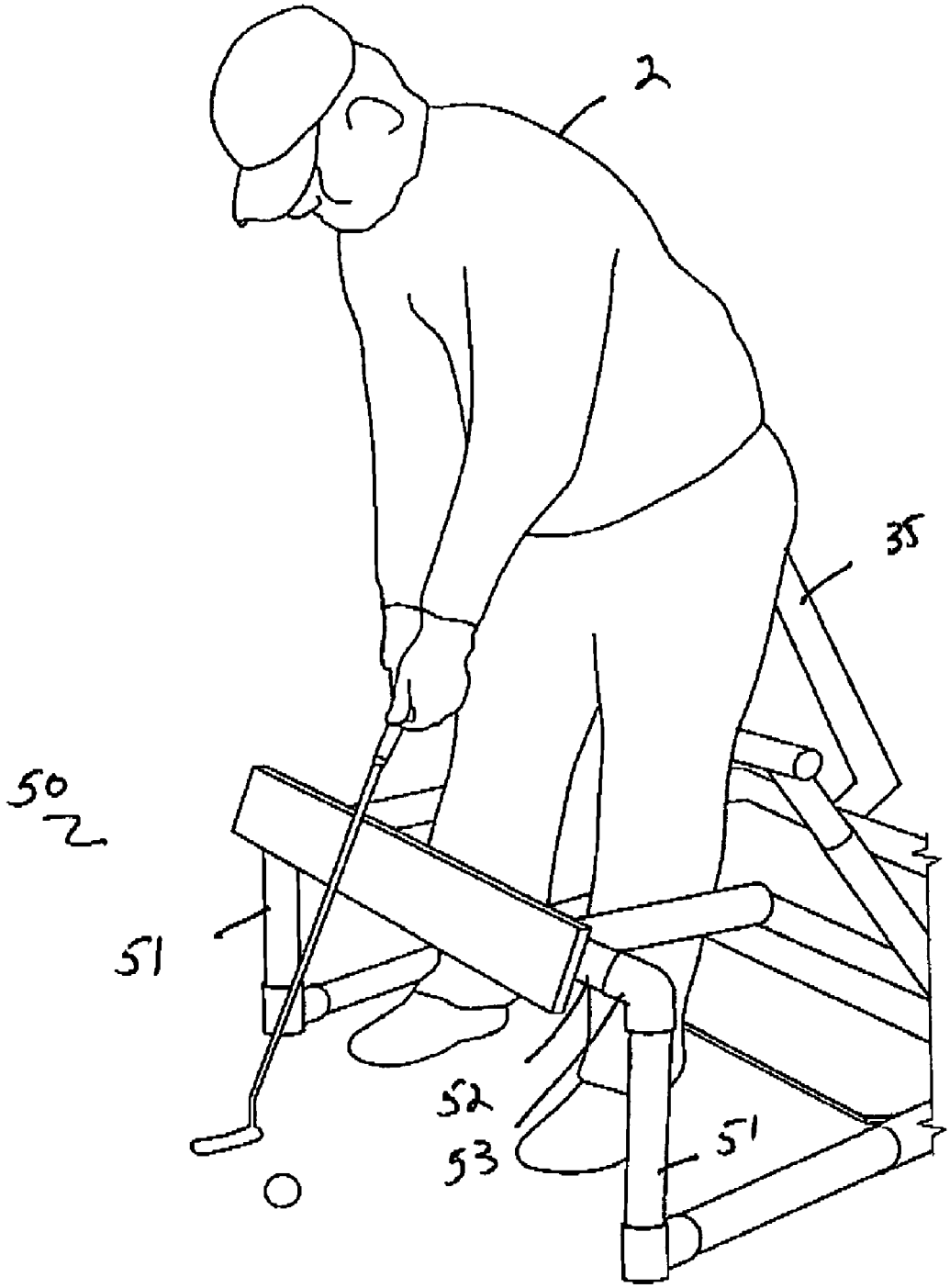
FIG. 15 is a front perspective view of the putting module attached to the base module with a golfer.
Figure 16:
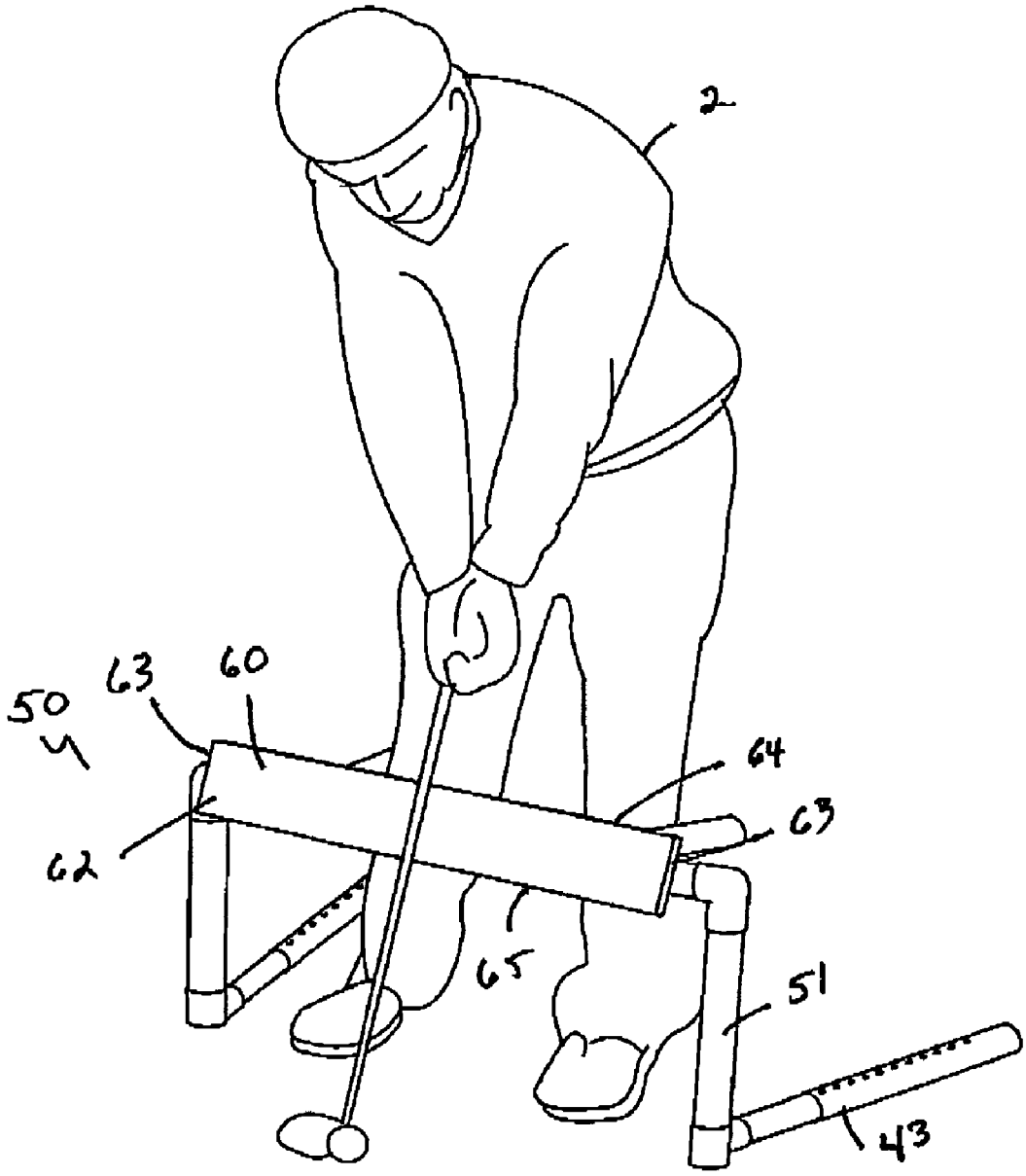
FIG. 16 is a front perspective view of the putting module with a golfer.
Figure 17:
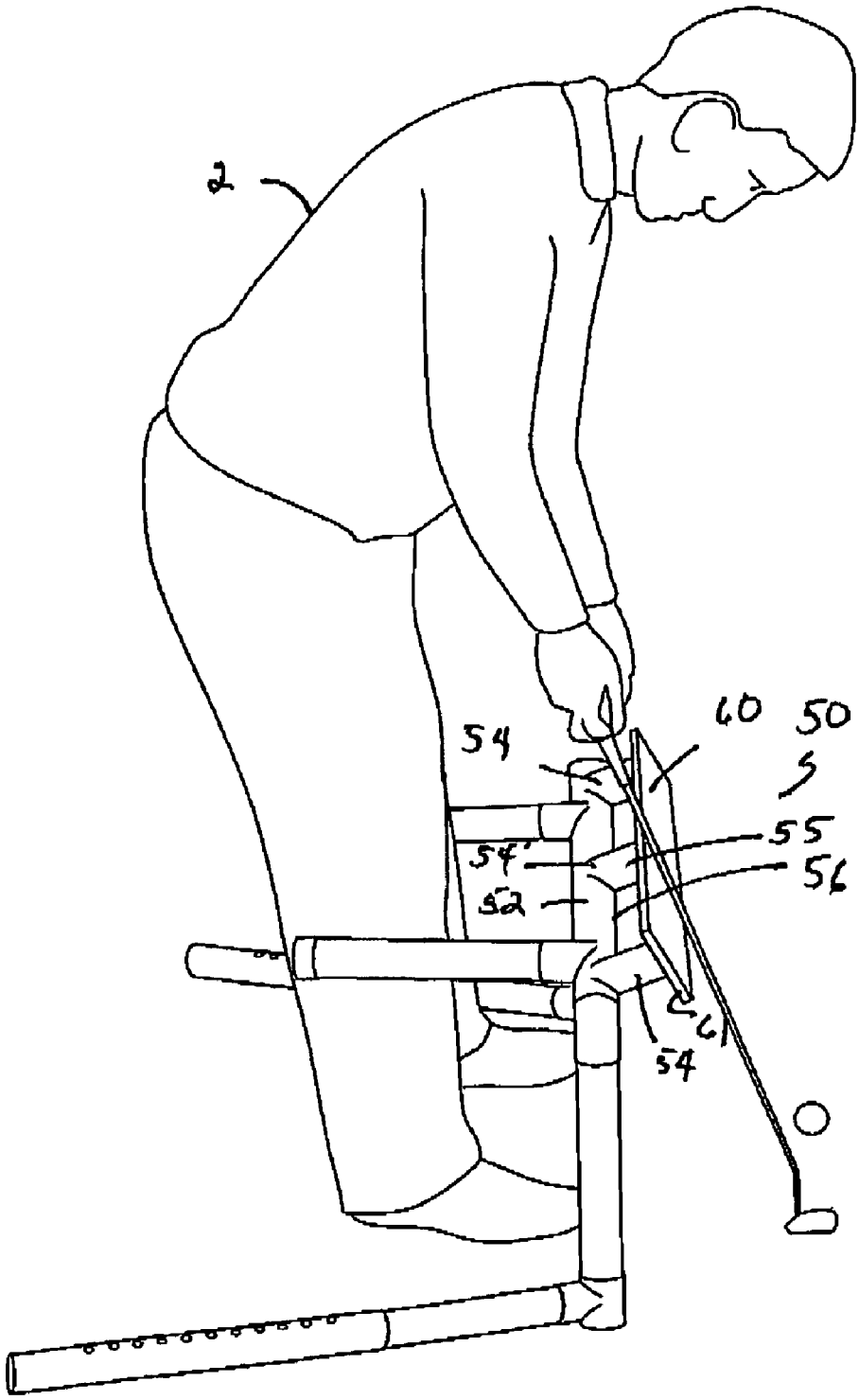
FIG. 17 is a side perspective view of the putting module with a golfer.

For purposes of exposition, it has been assumed that the golfer using the work station is right handed. The work station is easily adapted for a left handed golfer. In operation, the golfer 2 stands at the base module front 11 forward of the base plate front edge 29. The right knee guide pivot element 20 is adapted to fit behind the right knee of a golfer 2, with the pivot element forwarding extending protrusion 23 positioned just to the outside of the golfer's right knee. The target knee rod inside end 25 is positioned against the outside of the golfer's left knee. The training purpose of the base module 10 is primarily to eliminate "sway" in a golfer's swing. The right knee guide pivot element 20 keeps the golfer from "pulling up" and/or swaying rightward during golf club take away. The left knee guide target knee rod inside end 25 places pressure against the outside of the golfer's left knee thereby halting leftward sway as the golfer striker through the golf ball. See FIGS. 1-3.

The rear attachment module 30 is comprised of an elongated rear support bar 31 having a longitudinal axis parallel to the longitudinal axis of the base bar 19. The rear support bar 31 is positioned toward the base module rear 12 and is pivotally connected at each end 32 to the base bar 19. A posture bar receiver 33 is pivotally attached to the rear support bar 31. The posture bar receiver 33 is adapted to receive a telescoping posture bar 34. The posture bar 34 is adapted to receive an elongated foam posture rest 35. The foam posture rest 35 may be a an expanded plastic tube made from polystyrene and sold under the trademark, STYROFOAM. The posture bar 34 and posture rest 35 have an elongated axis transverse to the longitudinal axis of the rear support bar 31.

In operation, the rear attachment module 30 is designed to assist the golfer in maintaining a proper posture and body bend during the golf swing. The posture rest 35 is forwardly pivoted to a desire angle which should correspond to the desired body angle bend for a particular golfer. In combination with the base module 10, the posture rest 35 provides a more complete guide for a golfer's stance and body during the golf swing. See FIGS. 3-6.

The front attachment module 40 is comprised of an elongated forward support bar 41 having a longitudinal axis parallel to the longitudinal axis of the base bar 19. The forward support bar 41 is positioned toward the base module front 11 and is pivotally connected at each end 42 to the base bar 19. Two generally horizontal telescoping pipes 43 are connected to the forward support bar 41 and extend forward away from the base module front 11. The horizontal telescoping pipes each terminate in a rotating and adjustable elbow 44. Each elbow 44 has a swing plane bar 45 extending therefrom. Each swing plane bar 45 is adapted to receive an elongated foam swing plane foam tube 46. Preferably the foam tube is an expanded plastic made from polystyrene and sold under the trademark, STYROFOAM.

In operation, the front attachment module 40 is designed to assist the golfer in maintaining a desired swing plane. The right swing plane foam tube 46 guides the golfer's club during take away at a desired plane angle. The left swing plane foam tube 46' guides the golfer's club during follow through after striking the golf ball. In combination with the base module 10 and the posture rest 35, the swing plane tubes provide a complete guide for a golfer during the golf swing. See FIGS. 7-12.

The putting module 50 is comprised of the front attachment module elongated forward support bar 41 and the two generally horizontal telescoping pipes 43 connected to the forward support bar 41 and extend forward away from the base module front 11. The horizontal telescoping pipes 43 each terminate in a rotating and adjustable elbow 44. Each elbow 44 has a putting height bar 51 extending therefrom. The putting module 50 is further comprised of an elevated support bar 52 having two opposite ends 53, each elevated support bar end terminating in a said height bar 51. The elevated support bar 52 has a longitudinal axis which is parallel to the longitudinal axis of the forward support bar 41. The elevated support bar has three rotating tees 54 attached thereto on an elevated support bar front side 56, said rotating tees being parallel to each other and lying along a generally horizontal axis. A generally planar putter shaft slide 60 is attached to the first and third rotating tees. The middle rotating tee 54', i.e., second rotating tee, has an adjustable depth element 55. The putter shaft slide 60 is a generally flat rectangular element having an inside surface 61 and an opposite outside surface 62. The putting attachment has two opposite short sides 63, an upper long side 64 and a lower long side 65. The short sides 63 are generally vertical and the long sides 64, 65 are generally horizontal. The putter shaft slide inside surface 61 is attached to the first and third rotating tees 54. The middle rotating tee depth element 55 is adapted to force the putter shaft slide 60 to curve outward by placing pressure on the inside surface 61 at the approximate mid point of the putter shaft slide. The upper long side 64 has a shoulder arc radius 66 formed therein.

In operation, the putting module 50 addresses the one golf shot which is not addressed by the previous modules, i.e., the putt. The curve of the putter shaft slide 60 provides a slide or plane angle for a putter shaft. With a guide clip attached to the shaft of the golfer's putter and interacting with the shoulder arc radius 66, the putter movement through the ball accounts for swing plane and shoulder turn. See FIGS. 13-17.

It is understood that the above-described embodiment is merely illustrative of the application. Other embodiments may be readily devised by those skilled in the art which will embody the principles of the invention and fall within the spirit and scope thereof.

I claim:

1. A golf work station for teaching and reviewing techniques used in playing golf, comprising:

a base module having a front, rear, and two opposite sides, said base module front and rear defining a work station central axis, said base module opposite sides defining a base module transverse axis, comprising:

a base plate having a bottom surface and a top surface, said base plate bottom surface adapted to rest on an indoor floor or outdoor surface such as a mat or ground;

a base bar fixedly attached centrally to the base plate top surface, said base bar having a longitudinal axis parallel to the base module transverse axis;

two telescoping knee guides, a left knee guide and a right knee guide, each pivotally extending from said base bar, wherein:

the right knee guide terminates in an elongated pivot element, said right knee guide pivot element having a longitudinal axis parallel to the base module transverse axis, said right knee guide pivot element having an inside end and an outside end, said right knee guide pivot element outside end terminating in a forwarding extending protrusion;

the left knee guide terminates in an adjustable target knee rod with an inside end and an outside end, said knee rod inside and outside ends defining a target knee rod longitudinal axis, said target knee rod longitudinal axis being parallel to the base module transverse axis.

2. A golf work station as recited in claim 1, further comprising a rear attachment module removably attached to the base module rear, comprising:

an elongated rear support bar with two ends, said ends defining a rear support bar longitudinal axis, said rear support bar longitudinal axis parallel to the longitudinal axis of the base module base bar, said rear support bar positioned toward the base module rear and pivotally connected at each end to the base module base bar;

a posture bar receiver pivotally attached to the rear support bar;

a telescoping posture bar having two ends, one end being inserted into said posture bar receiver;

an elongated posture rest sleeve partially slid over said telescoping posture bar, said posture bar and posture rest have a combined longitudinal axis transverse to the longitudinal axis of the rear support bar.

3. A golf work station as recited in claim 2, further comprising a front attachment module attached to the base module front, comprising:

an elongated forward support bar with two ends, said ends defining a forward support bar longitudinal axis parallel to the longitudinal axis of the base bar, said forward support bar positioned toward the base module front and is pivotally connected at each end to the base module base bar;

two generally horizontal telescoping pipes connected to the forward support bar near each forward support bar end and extending forward away from the base module front, each horizontal telescoping pipe terminating in a rotating and adjustable elbow, each adjustable elbow having a swing plane bar extending therefrom, each swing plane bar having an elongated swing plane tube extending therefrom.

4. A golf work station as recited in claim 3, further comprising a putting module removably attached to said base module, comprising:

the front attachment module elongated forward support bar and the two generally horizontal telescoping pipes connected to the forward support bar and extend forward away from the base module front, said horizontal telescoping pipes each terminating in a rotating and adjustable elbow;

a putting height bar extending from each adjustable elbow;

an elevated support bar having two opposite ends, each elevated support bar end terminating in a said putting height bar, said elevated support bar having a longitudinal axis which is parallel to the longitudinal axis of the forward support bar;

a plurality of rotating tees attached to an elevated support bar front side, said rotating tees being parallel to each other and lying along a generally horizontal axis; and a generally planar putter shaft slide attached to said rotating tees.

5. A golf work station as recited in claim 4, wherein:

the putter shaft slide is a generally flat rectangular element having an inside surface and an opposite outside surface, said putter shaft slide having two opposite short sides, an upper long side and a lower long side, said short sides being generally vertical and said long sides being generally horizontal.

6. A golf work station as recited in claim 5, further comprising:

a middle rotating tee having an adjustable depth element, said middle rotating tee depth element adapted to press against the putter shaft slide inside surface force the putter shaft slide to curve outward.

7. A golf work station as recited in claim 6, wherein:

a shoulder arc radius is formed on the putter shaft slide upper long side.

8. A golf work station as recited in claim 7, further comprising:

a plurality of storage holders fixedly attached to the base plate top surface between the base bar and a rear base plate edge.

9. A golf work station as recited in claim 8, wherein:

said posture rest sleeve is an expanded plastic made from polystyrene.

10. A golf work station as recited in claim 9, wherein:

said elongated swing plane tubes are each an expanded plastic made from polystyrene.

* * * * *